US005330701A

United States Patent [19]

Shaw et al.

[11] Patent Number: 5,330,701

[45] Date of Patent: Jul. 19, 1994

[54] PROCESS FOR MAKING FINELY DIVIDED INTERMETALLIC

[75] Inventors: Karl G. Shaw; David E. Alman, both of Troy; René M. Cooper, Ballston Spa, all of N.Y.; Randall M. German, State College, Pa.; Kazuo P. McCoy, Troy, N.Y.

[73] Assignee: Xform, Inc., Cohoes, N.Y.

[21] Appl. No.: 843,605

[22] Filed: Feb. 28, 1992

[51] Int. Cl.[5] ..... B22F 9/00

[52] U.S. Cl. ..... 419/10; 419/13; 419/47; 75/351; 75/352; 75/356

[58] Field of Search ..... 75/231, 243, 249, 331, 75/351, 354, 356, 380, 255, 352; 419/10, 23, 49, 13, 47

[56] References Cited

U.S. PATENT DOCUMENTS

| | | | |
|---|---|---|---|
| 3,754,905 | 8/1973 | Knopp | 75/227 |
| 4,016,736 | 4/1977 | Carrison et al. | 72/41 |
| 4,149,876 | 4/1979 | Revat | 75/363 |
| 4,311,490 | 1/1982 | Bovenkerk et al. | 51/307 |
| 4,695,321 | 9/1987 | Akashi et al. | 75/243 |
| 4,762,558 | 8/1988 | German et al. | 75/246 |
| 4,807,402 | 2/1989 | Rai | 51/293 |
| 4,909,842 | 3/1990 | Dunmead et al. | 75/236 |
| 4,915,903 | 4/1990 | Brupbacher et al. | 420/129 |
| 4,916,029 | 4/1990 | Nagle et al. | 428/614 |
| 4,946,643 | 8/1990 | Dunmead et al. | 419/12 |
| 5,015,290 | 5/1991 | Tiegs et al. | 75/232 |
| 5,015,440 | 5/1991 | Boublen | 419/31 |
| 5,198,188 | 3/1993 | Holt et al. | 419/45 |

*Primary Examiner*—Donald P. Walsh
*Assistant Examiner*—Ngoclan T. Mai
*Attorney, Agent, or Firm*—Heslin & Rothenberg

[57] ABSTRACT

A method is disclosed for controlling a self-propagating reaction in a particulate medium. The method comprises controlling the boundary heat flux of the reaction to produce reaction waves which travel through the particulate medium undergoing a self-propagating reaction. The method provides a product having a unitary, solid structure with layers of alternating density. Preferably the reaction is a reaction between two metals to produce an intermetallic compound or between a metal and a non-metal to produce a ceramic compound. Nickel aluminide is a preferred intermetallic compound. Also disclosed is a controlled reactive sintering process for producing a finely divided intermetallic compound comprising comminuting the layered body of intermetallic compound. Also disclosed are a process for preparing an abrasive surface composed of a nickel aluminide binder and an abrasive material, an injection molding composition for preparing shaped articles of nickel aluminide, and a process for injection molding shaped nickel aluminide articles of greater than 98% theoretical density.

6 Claims, 3 Drawing Sheets

20μm

20μm

10 μm

20μm

1mm

PROCESS FOR MAKING FINELY DIVIDED INTERMETALLIC

BACKGROUND OF THE INVENTION

Field of the Invention

The invention relates to a controlled temperature reactive sintering process for producing finely divided intermetallic and ceramic powders, particularly nickel aluminide powders, to the use of these powders as binders for cutting tools and to compositions and processes for injection molding using these powders.

Information Disclosure

Intermetallic compounds are current candidates for use as turbine blades, engine components, dental and surgical instruments, heating elements, and several other applications requiring high temperature, oxidation-resistant materials. The intermetallic compounds based on aluminum (e.g., nickel aluminide, titanium aluminide, iron aluminide, and niobium aluminide) have the attractive characteristics of low density, high strength, good corrosion and oxidation resistance, and relatively low cost. In some cases, the intermetallics exhibit the unique property of increasing strength with increasing temperature. This property coupled with relatively high melting temperatures make for ideal high temperature materials. The specific combination of low density and high strength (referred to as a high strength-to-weight ratio) makes these materials excellent candidates for uses in which high strength is required in conjunction with minimum weight.

Reactive sintering is a powder metallurgy process which can be used to create intermetallic and ceramic compounds. The reaction is sustained by a transient liquid phase generated by the exothermic self-heating associated with compound formation. Reactive sintering is a special case of combustion synthesis in which densification occurs in conjunction with the combustion synthesis process. The transient liquid phase that is generated aids in the densification process. Processing time is on the order of one hour to produce high-density and high-strength parts from mixed elemental powders. Heat is liberated in the process as the constituent powders react to form an intermetallic compound and the reaction is thus self-sustaining. The process has many variants and names including reactive sintering, self-propagating high temperature synthesis (SHS), and combustion synthesis. Compound systems being developed with the process range from intermetallics such as NiAl, TiAl, $MoSi_2$, $Ni_3Si$, $Ni_3Al$, $Ni_3Fe$ and $NbAl_3$ to ceramics such as TiC, $TiB_2$, $Si_3N_4$, NbN and WC. SHS techniques are attractive because they involve low processing costs and produce intermetallic compounds at relatively low temperatures.

U.S. Pat. No. 4,762,558 (German et al.) relates to the formation of a densified $Nl_3Al$ compound employing reactive sintering on a shaped compact. The patent discloses a means for forming nickel aluminide intermetallic shapes by reactively sintering a compacted mixture of elemental nickel and aluminum powders to form a dense structure. By this approach densified parts and shapes may be formed from the elemental powders. The process of the '558 patent is well suited to the formation of monolithic, uniformly highly dense bodies of $Ni_3Al$. For many manufacturing applications however, it would be highly desirable to have very finely divided powders of intermetallics. Unfortunately the very properties of intermetallics, in this case nickel aluminide, that make them attractive also make them difficult to comminute. Dense, monolithic bodies produced by methods similar to U.S. Pat. No. 4,762,558 are not easily comminuted into powders.

For this reason intermetallic powders are typically produced by an atomization process in which a stream of molten metal is broken up into droplets by a stream of liquid, in most cases water, or by a jet of gas. The droplets then solidify to form metal powders. Intermetallics pose a special problem for atomizing because of the tendency of the material to oxidize at the high temperatures required for processing. Additionally, it is difficult to form the proper intermetallic compound because of segregation of the elemental species (i.e., nickel and aluminum for $Ni_3Al$) during solidification. The particle sizes which are formed are not sufficiently fine in diameter (i.e., 20 micrometers and less) for applications requiring lower sintering temperatures and for processes such as powder injection molding. Intermetallic powders, which are formed currently by atomizing, are in short supply and are very costly.

Clearly, a need exists for processes for producing powders that permit the use of commercially available starting materials, comparatively low processing temperatures, and short process times.

SUMMARY OF THE INVENTION

It is an object of the invention to provide a process for making finely divided intermetallic and ceramic powders that permits utilization of commercially available starting materials, low processing temperatures, and short duration process cycles.

It is a further object to produce a desired intermetallic or ceramic compound of specific elemental composition directly from the elemental constituents as starting materials and without the need for providing a corresponding preformed compound of such elemental constituents as starting material.

It is a further object to provide a process and composition using a finely divided intermetallic, nickel aluminide, as a binder for abrasives in a cutting tool.

It is a further object to provide a composition and a process for injection molding using finely divided intermetallic powders.

In one aspect the invention relates to a method for controlling a self-propagating reaction in a particulate medium comprising controlling the boundary heat flux of the reaction to produce reaction waves which travel through the particulate medium undergoing self-propagating reaction. The method provides a product having a unitary, solid structure with layers of alternating density. It is preferred that layers have a periodicity of 100 μm to 3 mm. Preferably the reaction is between two metals to produce an intermetallic compound or between a metal and a non-metal to produce a ceramic compound. The metals are preferably chosen from the group consisting of iron, nickel, aluminum, titanium, molybdenum, niobium, tantalum, cobalt and silicon, and the non-metal is chosen from the group consisting of carbon, boron and nitrogen. Nickel aluminide is a preferred intermetallic compound.

In another aspect, the invention relates to a controlled reactive sintering process for producing a finely divided intermetallic compound comprising:

(a) intimately mixing finely divided reactants;

(b) bringing a portion of the intimately mixed reactants in a protective atmosphere to a temperature sufficient to initiate an exothermic reaction and to form a transient liquid phase;

(c) providing a heat sink to control the exothermic reaction so as to produce a layered body of intermetallic compound;

(d) cooling the layered body of intermetallic compound in an inert atmosphere; and (e) comminuting the layered body of intermetallic compound to provide a finely divided intermetallic compound.

The heat sink may be provided at least in part by adding a quantity of a product of a reaction to an intimate mixture of reactants for said reaction, or the heat sink may be in the form of a water cooled reaction vessel. The heat sink may additionally comprise a heat-transferring, but protective, atmosphere. The preferred intermetallic compound is nickel aluminide of particle size from 1 μm to 1 mm.

In another aspect, the invention relates to a process for preparing an abrasive surface composed of a nickel aluminide binder and an abrasive material. The process comprises:

(a) preparing a nickel aluminide powder of 5 to 40 μm average particle size as described above;

(b) mixing the nickel aluminide powder and an abrasive; and (c) consolidating the mixture.

In a preferred process the abrasive is diamond, and pressing is accomplished by hot pressing or hot isostatically pressing.

In another aspect, the invention relates to a nickel aluminide-diamond abrasive surface comprising a fully dense nickel aluminide and from 1 to about 20% by weight of diamond particles.

In another aspect, the invention relates to an injection molding composition for preparing shaped articles of nickel aluminide of greater than 98% of theoretical density comprising:

(a) a nickel aluminide powder of mean particle size from 2 to 20 μm; and (b) a binder.

Preferably the binder is a mixture of polymer, wax and fatty acid, and the mixture is at least partially soluble in a hydrocarbon solvent.

In a further aspect, the invention relates to a process for injection molding shaped nickel aluminide articles of greater than 98% theoretical density comprising:

(a) providing the foregoing composition for injection molding;

(b) injection molding said composition at 50 to 160 MPa and 100° to 140° C.;

(c) debinding; and (d) sintering in a reducing atmosphere at a temperature between 1340° and 1360° C.

DESCRIPTION OF PREFERRED EMBODIMENTS

Figure 1:
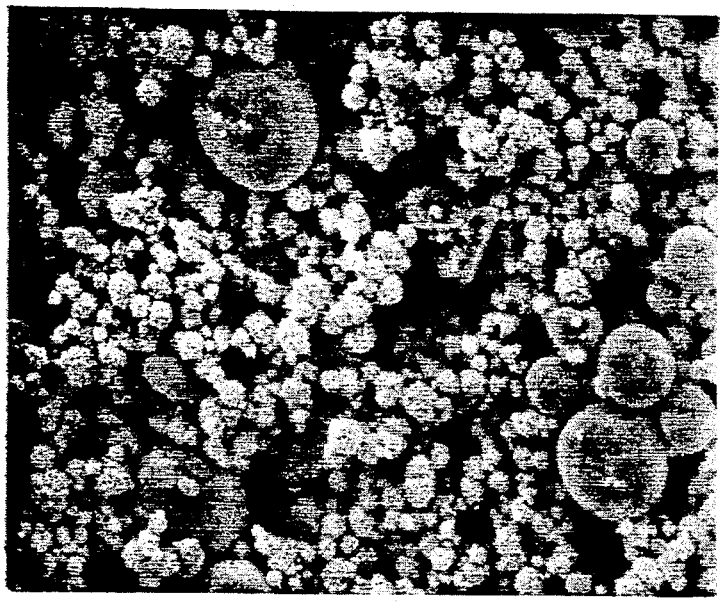
FIG. 1 is a photomicrograph of an intimate mixture of aluminum and nickel powders.

The general process of reactive sintering is described in R. M. German, Liquid Phase Sintering, Plenum, New York, N.Y., 1985, Chapters 7 and 8. An initial compact composed of mixed powders is heated to a temperature at which they react to form a compound product. Often the reaction occurs upon the formation of a liquid, typically a eutectic liquid, at the interface between contacting particles. For instance, in regard to a theoretical binary phase diagram for a reactive sintering system, where a stoichiometric mixture of two elemental powders A and B is used to form an AB intermediate compound product, the reaction occurs above the lowest eutectic temperature in the system, yet at a temperature at which the compound AB is formed.

At the lowest eutectic temperature, a transient liquid forms and spreads through the compact during heating. Generally heat is liberated because of the higher thermodynamic stability of the compound formed. Consequently, reactive sintering is nearly spontaneous once the liquid forms. By appropriate selection of the temperature, particle size, green density and composition, the liquid becomes self-propagating throughout the compact and persists for only a few seconds.

According to the present invention, a reactive sintering process is advantageously provided for producing a layered product of the desired compound to be formed for mechanical milling into powders. The elemental starting materials are mixed in the proper stoichiometric ratio to form the proper compound (e.g., $Ni_3Al$ or $Ni_{6.5}Al_{35}$) and are placed in a reactor in which the reaction is initiated and the reaction is controlled by limiting the spatial temperature distribution by maintaining appropriate heat transfer boundary conditions. This is achieved in practice by allowing the combustion synthesis to occur in a heat exchanger, at atmospheric or greater pressure. Processing gases with high thermal conductivities (i.e., $H_2$ or He) may be employed to aid in heat transfer.

According to an embodiment of the present invention, this process is effected by initiating an exothermic reaction within a mass of powders that have been mixed in the proper stoichiometric ratio to form a desired compound. The wave propagation associated with this self-propagating reaction is controlled by balancing the heat created by the reaction and that carried away due to heat extraction. The reaction may be controlled by maintaining sufficient heat transfer boundary conditions such that the buildup of heat is reduced. By controlling the propagation reaction, an oscillation in wave propagation is induced. The thrust of this invention is that the induced oscillation results in a product that is a unitary, porous, not fully densified, body of intermetallic or ceramic compound having periodic structural variations, corresponding to the wave oscillation, which exist in planes normal to the principal wave propagation direction. When the body is sheared along these planes, the body is easily milled. When the body is cylindrical, the cylinder is readily fractured into discs by virtue of its alternating regions of relatively lower and higher density. The discs are much easier to reduce to fine particle size by mechanical milling than is a monolithic body of comparable mass. A major advantage of this invention is that it provides an efficient and cost-effective means for the fabrication of intermetallic powders as well as ceramic powders for those intermetallic and ceramic systems capable of being formed by SHS. Examples of some intermetallic systems include $Fe_3Al$, NiAl, $Ni_3Al$, TiAl, $Ti_3Al$, $MoSi_2$, $NbAl_3$ and $Ni_3Fe$; TiC, $TiB_2$ $Si_3,N_4$, NbN and WC are examples of ceramics that may be formed by SHS. The SHS or reactive sintering reaction relies on the exothermic heat associated with compound formation to produce a transient liquid phase. Control over the transient liquid phase and the characteristics of the final product are possible through the heating rate, green density, degassing procedure, particle size, particle size ratio, powder homogeneity, and stoichiometry.

Consider a mixture of nickel and aluminum powders. These powders will form a stoichiometric compound such as NiAl or $Ni_3Al$ with the release of heat $\Delta Hf$, $$3Ni+Al \rightarrow Ni_3Al+\Delta Hf$$

The reaction from elemental powders results in the formation of a compound, in this case $Ni_3Al$, and the release of excess heat. Such reactions are thermally activated events with the rate of reaction dependent on the temperature. The rate is expressed by the equation:

$$\frac{dy}{dt} = (1-y)^n K_o e^{-E/RT} \quad (1)$$

where y is the fraction of reactant transformed (usually 1 or 2), n is the reaction order, $K_o$ is the frequency factor, E is the activation energy for the reaction, R is the gas constant, and T is the absolute temperature. An activation energy E is needed to initiate diffusion across the interface between contacting particles. The probability that a given atomic vibration will gather sufficient energy to undergo such a step varies in proportion to exp(−E/RT). Depending on the heat capacity of the material and the energy released during the reaction, a rise in temperature occurs, termed adiabatic heating. In turn, adiabatic heating leads to faster rates of reaction because of the strong rate sensitivity as expressed by the Arrhenius temperature dependence. This is especially true if a liquid should form. Such reactions are termed as autocatalytic because when once initiated, the reaction proceeds in a spontaneous manner without external heat input.

The parameters that influence SHS fall into two categories: those that are inherent to the system thermodynamics (such as heat capacity, activation energy, and heat of formation), and those that are adjustable through the processing conditions (such as particle size, heating rate, green density, and composition). The composition and corresponding reaction enthalpy, initial compact temperature, heat capacity and green density, and overall convective and conductive heat losses as dictated primarily by the reactor design and processing gases, determine the maximum temperature rise. Controlling this temperature rise is the fundamental step in efficient powder production. If the temperature of the reactant mass increases above the product melting temperature, then densification of the compact occurs through excessive transient liquid phase formation. If the overall compact temperature increase remains below the product melting temperature, then densification is impeded and the morphology of the powder compact is maintained.

The actual maximum temperature achieved is determined by an energy balance using the appropriate heat capacities and melting enthalpies. The adiabatic temperature $T_a$ represents the maximum possible temperature attainable in the reaction zone. It can be estimated using energy balance calculations, $$H_f = C_p \Delta T + H_m$$

$$\Delta T = T_a - T_i$$

where $H_f$ is the enthalpy of formation of the compound, $\Delta T$ is the temperature rise from the initiation temperature $T_i$ to the adiabatic temperature, $C_p$ represents the heat capacity for the various components, and $H_m$ is the appropriate collection of melting enthalpies. The maximum temperature depends on the particular combination of reactant and compound melting events. Each melting event consumes energy and lowers the maximum temperature, while higher initiation temperatures and higher reaction heats raise the maximum temperature. Diffusional homogenization is aided by having the maximum temperature approach the compound melting temperature. Control of the maximum temperature is possible through adjustments to the processing parameters, including the initiation temperature. Generally, the most desirable situations have temperature increases of 1500K. For NiAl the calculated $\Delta T$ is 1920K. Several other aluminides in addition to the nickel aluminides exhibit sufficient $\Delta T$ values for potential reactive synthesis by the process outlined herein.

Figure 5:
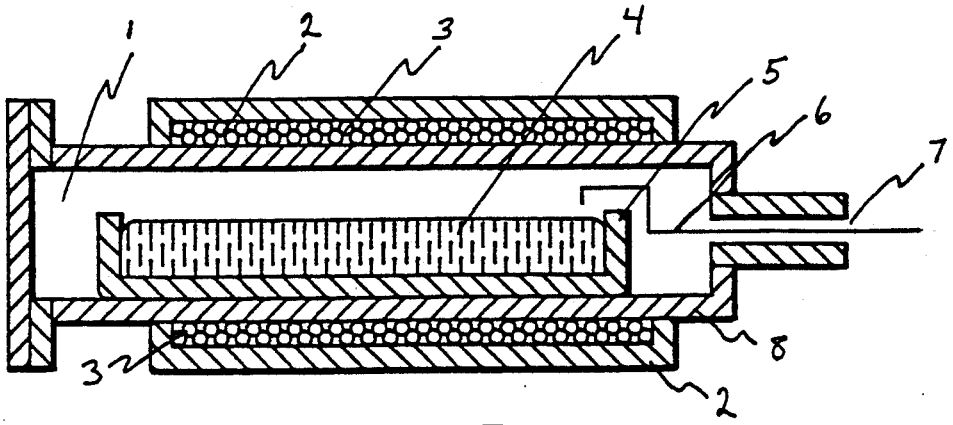
FIG. 5 is a cross-section of a reactor for use in the inventive process.

The rate of wave propagation is controlled by a balance of heat created by the reaction and that carried away due to heat extraction, as generally described by the relation:

$$C_p p \frac{\partial T(x,t)}{\partial t} = k \frac{\partial^2 T(x,t)}{\partial^2 x} + qpK_o(1-\phi)^n e^{-E/RT} \quad (2)$$

where:

$c_p$=heat capacity of product
p=density of product after reaction
x=propagation distance
t=time
T=temperature
k=thermal conductivity of reactant
q=heat of reaction
$K_o$=geometric constant
$\phi$=fraction of reactant transformed into product
n=reaction order exponent
x=o at the reaction boundary layer The reaction may be controlled by limiting the spatial temperature distribution by maintaining sufficient heat transfer boundary conditions, $$\frac{\partial T(x=0,t)}{\partial x} = K_1, \quad (3)$$

$$T(x=0,t) = T_o$$

where $K_1$ and $T_o$ are constants determined by the reactor design, such that the heat buildup is reduced. This is achieved in practice by allowing the combustion synthesis to occur in a heat exchanger, at atmospheric or greater pressure, utilizing processing gases with high thermal conductivities ($H_2$ or He), to aid in heat transfer. In the instant reactive sintering process, the elemental powders are randomly intermixed in a stoichiometric ratio ($3Ni+Al \rightarrow Ni_3Al$) such that the particles thereof initially are in point contact. The intimately mixed powder is placed in a reaction vessel as shown in FIG. 5 at ambient temperature (in most cases). A small area of the mix is brought to the eutectic temperature by one of the methods discussed below. Once the eutectic temperature is reached, the first liquid forms and rapidly spreads throughout the structure. The eutectic liquid consumes the elemental powders and forms a precipitated solid behind the advancing liquid front.

The configuration of the reaction vessel is such that thermal contact is made between the walls of the reactor and the container holding the reactants. Water at 10°–15° C. is passed through the cooling jacket at such a rate as to remove excess heat from the reaction to maintain the unreacted mixture at ambient temperature but not to remove so much heat that the reaction halts. The rate of required heat removal for a given intermetallic will be primarily a function of the size and shape of the reacting mass. For our studies the reacting mass of nickel and aluminum was 1700 g in a boat which is a split cylinder of 7.6 cm diameter 53 cm long. Water was provided at 10° to 12° C. and 4 L/min. The copper reactor walls conformed to the reaction boat. Argon at room temperature was passed through the reactor at 2 L/min. With this combination of parameters satisfactory layered products of 30% density and about 500 μm periodicity were formed reproducibly.

Typical nickel and aluminum powders useful for the reactive sintering process are the commercially available INCO type 123 elemental nickel (available from Novamet Div, INCO, Wyckoff N.J.) and Valimet type H-15 elemental aluminum (available from Valimet, Stockton Calif.). These powders are relatively pure and have Fisher subsieve size particle sizes near 3 and 15 micrometer, respectively. The Valimet powder minimizes surface oxide on the aluminum, since this is a helium atomized powder, although other aluminum particle sizes (e.g., 3, 10, 30 and 95 micrometer) and powder types may be used.

The proportional weights of the powders correspond to the stoichiometric mixture. For example, to make 1000 gms of $Ni_3Al$ would involve weighing out 867 gms of nickel (86.7 wt. %) and 133 gms of aluminum (13.3 wt. %). The powders are mixed using a turbula mixer for 30 minutes, but various mixing times and other mixing techniques may be employed. The powders are poured into a tray which is loaded into the reactor which is shown in FIG. 5. The powder has a green density of 20–35% and is degassed at 200° in vacuo for 2 hours. The powder mix is reacted in the reactor after the reactor has been purged with argon gas for roughly 15 minutes. Following reaction, the mixture is cooled in the reactor to prevent oxidation with the atmosphere. The compact consisting of a reacted mass (referred to as a "log") of about 30% density is then mechanically milled, by shearing in a direction perpendicular to the reaction wave, to produce powders. It is noted that the size yield of the powders is directly related to the speed and reaction temperature of the wave. As the wave increases in velocity and temperature, the milled "log" yields larger mean particle sizes. The type of mechanical milling (e.g. grinder or ultracentrifugal mill) along with milling times determine the final size of the powder. The powder may be screened or classified with an air classifier to separate the powders according to particle size.

Several experiments have been conducted to delineate the factors affecting SHS. These factors include particle size, green density, degassing procedure, compact size, reaction dilution, and atmosphere effects. Nickel, tantalum, titanium, cobalt, iron, and niobium aluminides have enthalpies heat capacities and melting points that allow SHS.

The initiation of the exothermic reaction may be accomplished by a number of separate and distinct techniques, including but not limited to furnace heating at a rate of at least 3 K/min, heating the powder mixture with an electrically heated coil, sparking the powder mixture with an electrode through which current passes, passing current through the powder to generate localized hot spots at the high resistance contact areas of particle to particle contact, starting the reaction utilizing an "electric match," or generally any technique which provides sufficient heat to generate a transient liquid at the corresponding liquidus temperature to initiate the exothermic reaction. Some systems (e.g., $Fe_3Al$) require that the temperature of the reactant mixture be raised to assist initiation; this may be achieved in practice by externally heating the mixed powder to a temperature above ambient prior to initiation.

Following the reaction process, the log is broken into powder employing a shearing and crushing mode of deformation. This is accomplished initially using a screw-type grinder. The powder at this point is separated by particle size and the larger particles are further attritted by either an ultracentrifuge mill which rotates at up to 20,000 rpm, or by attritor milling, ball milling, or by mortar and pestle.

FIG. 1 shows the unreacted powder mixture; a mixture of nickel and aluminum powders is shown in this example.

Figure 2:
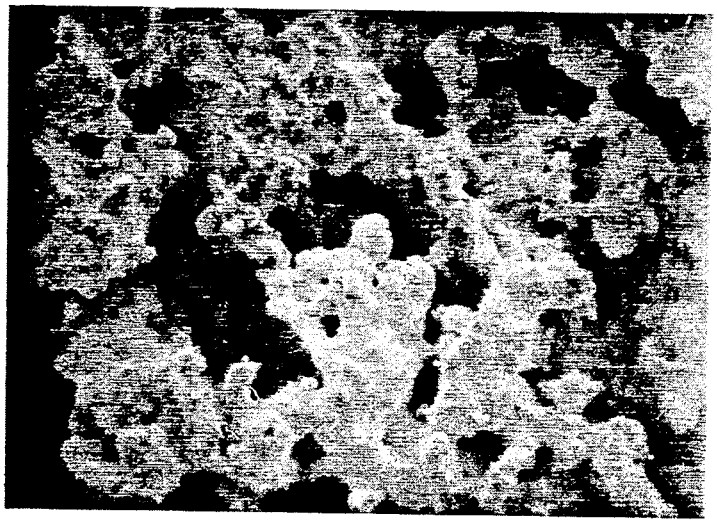
FIG. 2 is a photomicrograph of a product of a reactive sintering process under conventional conditions.
Figure 3:
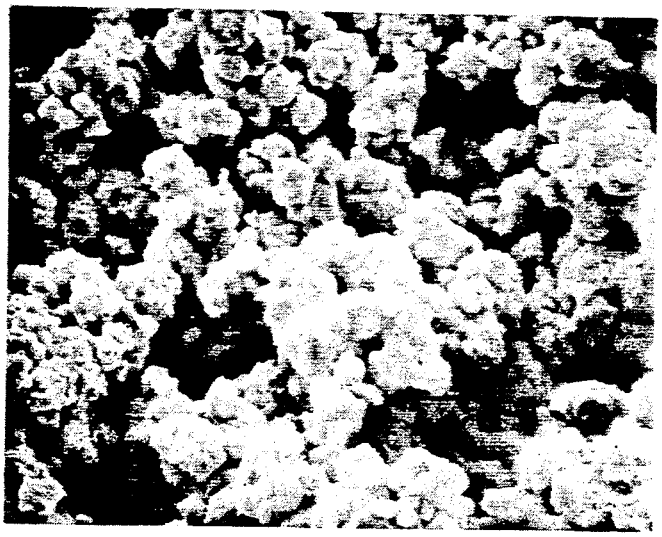
FIG. 3 is a photomicrograph of a product of the process of the invention.

The effect of reacting in a heat exchanger and reducing the adiabatic temperature by mixing pre-reacted material with the unreacted mixture is shown in FIG. 3 versus reacting in a furnace under argon in FIG. 2.

Figure 4:
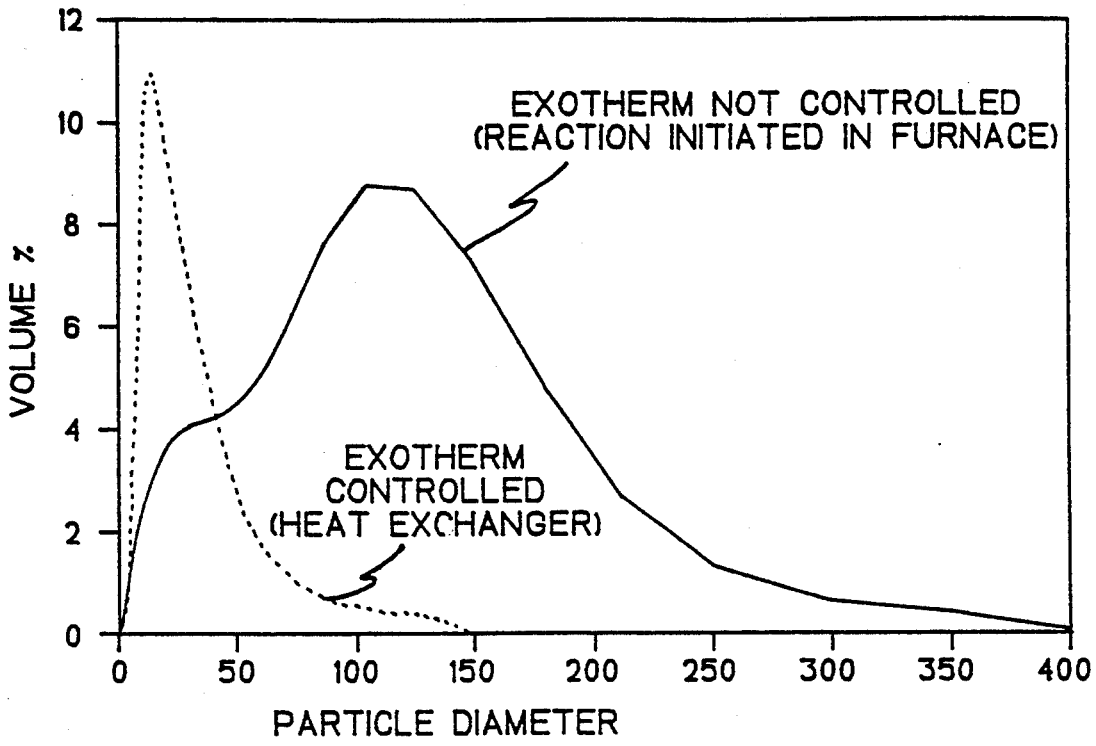
FIG. 4 is a plot of particle size distributions for a process of the art and the process of the invention.

FIG. 4 shows the distribution of particle sizes from an SHS process in which the boundary heat was not controlled and the narrower distribution of smaller diameter particles obtained from controlling the boundary heat according to the present invention.

FIG. 5 is a cross-section of the apparatus used in the process. The appropriate purge gas is led into the reaction chamber at one end I and exhausted at the other end 7. The igniter 6 is passed into the reaction chamber through the exhaust 7. The material to be sintered 4 is placed in a boat 5 which is in intimate contact with the walls of the reaction chamber 8. The walls are cooled by water 3 passing through a water jacket 2 surrounding the cylindrical chamber.

Figure 6:
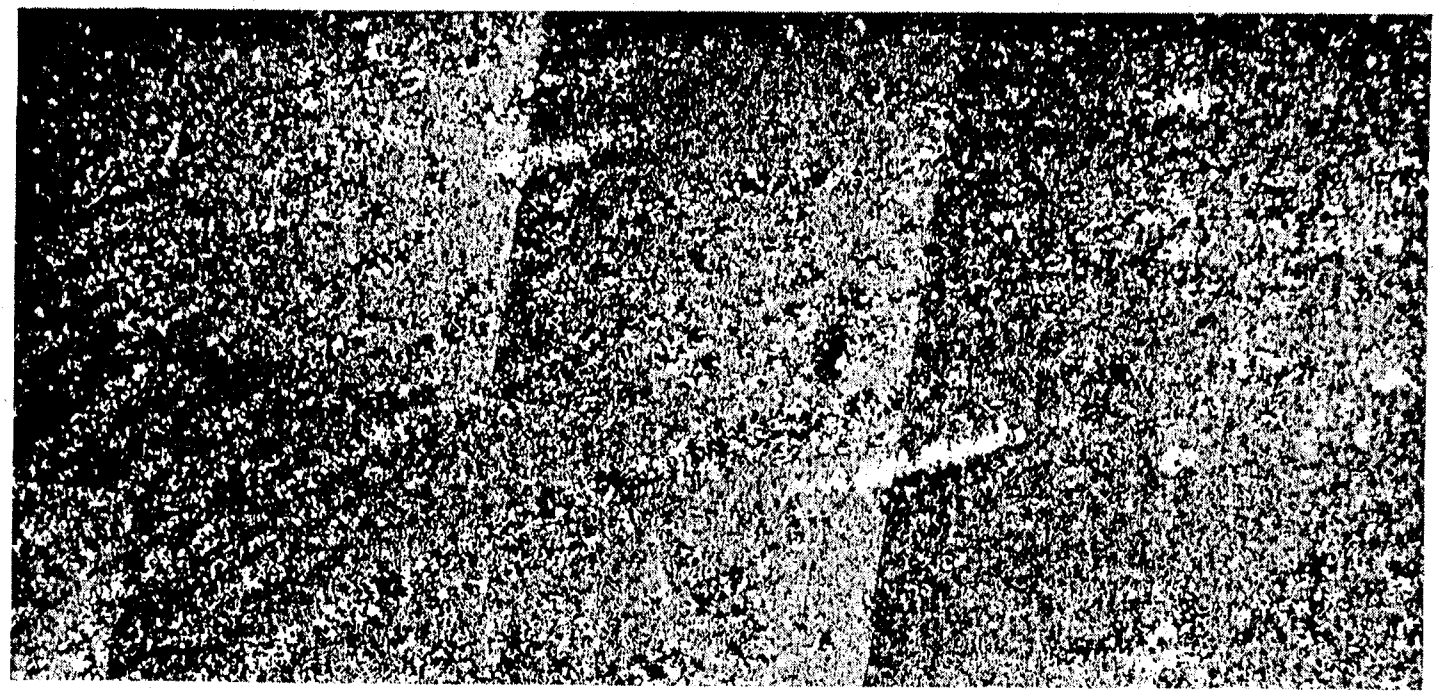
FIG. 6 is a photomicrograph of a unitary, porous body of nickel aluminide showing periodic structural variations.

FIG. 6 is a photomicrograph showing the layered structure of the "log" before milling.

The product of the self-propagating reaction may be a composite material containing different phases depending on the equilibrium phase diagram of the material. As an example, nickel and aluminum powders that are mixed in the stoichiometric blend to form $Ni_3Al$ will consist of the phases $Ni_3Al$, NiAl, $Ni_5Al_3$ and Ni (nickel). The amount of each phase may be controlled by the boundary conditions on the reactive sintering powder process. This composite structure may be advantageous in the case of nickel aluminides by providing a ductile phase, Ni, which allows the materials to be pressed together prior to sintering with sufficient green strength to allow ejection of the shape from a die and handling of the part. An added feature of this process is that the nickel also acts as a sintering aid and permits the powder to be sintered to high theoretical densities. The composite structure may be mechanically milled into powders directly after the reactive sintering powder process, or the composite may be annealed to eliminate the phases which are not predicted based on the stoichiometric mixing of the elemental powders. A representative anneal is two hours at 900° C. in vacuum to reduce the amount of the non-stoichiometric phases but to retain the composite structure. After the anneal, the structure is mechanically milled into powders. Alternatively, the composite structure may be mechanically milled prior to annealing. Phase pure powders, formed either by post annealing composite powders or allowing the exotherm to increase in temperature, may be advantageous in thermal spray applications.

Intermetallic powders corresponding to the NiA1, $Ni_{65}Al_{35}$ and $Ni_3Al$ compositions may be prepared similarly. These nickel aluminides also form a layered product by control of the propagation wave associated with the reactive sintering process. Subsequent annealing forms the desired stoichiometric compound. A feature of the process is that it produces a reacted product which may be readily mechanically milled to generate powders which may range from one micrometer in diameter to greater than 1000 micrometers in diameter. The process yield for a given size range is directly influenced by the heat transfer condition which is affected primarily by the feedstock composition and reactor design. An added feature of this process is that a range of powder sizes are possible based on the process. Mean particle sizes of 16 micrometers in diameter have been produced for use in cutting tool applications and for metal injection molding. Particle sizes ranging from 38 and 53 micrometers to 106 micrometers have been produced for conventional press and sinter powder metallurgy processing, and for thermal and plasma spray applications.

For the $Ni_3Al$ nickel aluminide composition, the nickel powder is present in an amount of generally about 84.0–88.0 by weight (wt. %), preferably about 84.5–87.5 wt. %, more preferably about 85.5–87.5 wt. %, and especially about 86.7 wt. % of the mixture. Generally, the nickel powder is present in a particle size of about 3 micrometers in diameter, and the aluminum powder is present in a particle size of about 3–30 micrometers, and preferably about 15 micrometers.

For the $Ni_{65}Al_{35}$ nickel aluminide composition, the nickel powder is present in an amount of generally about 78.0–81.0 by weight (wt. %), preferably about 79.0–81.0 wt. %, and especially about 80.2 wt. % of the mixture. Generally, the nickel powder is present in a particle size of about 3 micrometers in diameter, and the aluminum powder is present in a particle size of about 3–30 micrometers, and preferably about 15 micrometers.

For the NiAl nickel aluminide composition, the nickel powder is present in an amount of generally about 65.0–75.0 by weight (wt. %), preferably about 68.0–69.0 wt. %, and especially about 68.5 wt. % of the mixture. Generally, the nickel powder is present in a particle size of about 3 micrometers in diameter, and the aluminum powder is present in a particle size of about 3–30 micrometers, and preferably about 15 micrometers.

Additional alloying additives may be included in the composition according to the present invention to improve the properties of the basic $Ni_3Al$ intermetallic compound. Preferred additives include boron, e.g. up to about 1%, to improve ductility, chromium, e.g. up to about 5%, to improve oxidation and corrosion resistance, hafnium, e.g. up to about 2%, to improve high temperature creep resistance, and iron, e.g. up to about 10%, to improve mechanical strength and ductility. These are generally provided as elemental fine particle constituents admixed into the composition forming the green compact, or they may be prealloyed with the nickel component used herein.

As a result of the inventive process, very small particle size intermetallic compounds can be provided for the first time in quantities that enable them to be used as binders for abrasives and as components of injection molding compositions.

Nickel aluminide powder corresponding to the composition $Ni_3Al$ may be combined with diamond powder and then processed by means of hot pressing or hot isostatic pressing to form a fully dense composite nickel aluminide-diamond structure. A composite material consisting of diamond within a nickel aluminide matrix has application in drilling, cutting and grinding applications. Drill bits as well as cutting blades or grinding wheels consisting of nickel aluminide and diamond may be produced. The diamond serves as the abrasive and the nickel aluminide as the binder for the diamond. In this respect nickel aluminide powder may replace cobalt powder, which has been traditionally employed as a binder material in diamond cutting tools. In addition to diamond, other abrasives may be combined in a composite with nickel aluminide. These would include alumina; carbides such as tungsten carbide, silicon carbide, hafnium carbide and vanadium carbide; and nitrides, such as cubic boron nitride, titanium nitride and silicon nitride. The $Ni_3Al$ composition, in the form of a powder that measures roughly 20 micrometers in diameter, has been mixed with diamond powder which represents up to 20 weight percent of the total mixture and has been fully densified by both hot isostatic pressing at 35 MPa for 20 minutes at 1150° C. and by hot pressing at 28 MPa at 1050° C. for 5 minutes. The nickel aluminide bonds to the diamond to form a coherent composite structure of nickel aluminide and diamond.

The preferred binder composition of $Ni_3Al$ for use with diamond powder contains 0.04 wt. % boron.

It is oftentimes useful and desirable to form specific shapes. Many intermetallic systems can be processed into shapes from their powders utilizing techniques such as hot pressing and hot isostatic pressing. A clear problem in developing these techniques is the lack of low-cost commercially available powders. This invention provides a method for injection molding nickel aluminides by employing the reactive sintering powder process to produce powders which are of the proper size and shape for injection molding. Powder injection molding offers the advantage of being able to form intricately shaped parts. Injection molding of nickel aluminides using atomized nickel aluminide powders of the art yields molded parts having large residual porosity primarily due to the large particle size of the powders. Metal particles which measure roughly 20 micrometers in mean particle size and which are fairly spherical are better suited for powder injection molding (also called metal injection molding) than are larger diameter particles. With powders produced by the process of the invention, tensile bars and 9 mm wrenches have been produced by injection molding and 99% theoretical density has been achieved following sintering. The processing steps include the following:

(a) providing a composition comprising nickel aluminide and a binder. The binder is preferably a mixture of a polymer, a wax and a fatty acid;

(b) injection molding the composition at 50 to 160 MPa and 100° to 140° C.;

(c) debinding; preferably in a hydrocarbon solvent and (d) sintering in a reducing atmosphere at a temperature between 1340° and 1360°.

Prior to injection molding studies, the powders were fully characterized to determine their applicability for injection molding. X-ray diffraction confirmed the presence of $Ni_3Al$. An $Ni_3Al$ containing 0.04% boron was used for molding. Powders with a mean particle size of less than 20 micrometers are required for injection molding. The particle size summary for the powders that were injection molded is shown below:

| Cumulative Percent | less than (Micrometers) |
|---|---|
| 90 | 27 |
| 50 | 14 |
| 10 | 8 |

The mean particle size is 16 micrometers and the powders have an apparent density of 43% and a tap density of 52%.

Samples of tapped powder were sintered in vacuum at 1340° C. for one hour and a density of 97% (7.2 g/cc) was obtained. The rickets hardness with a 100 gf load averaged 286. The same powder was hot isostatically pressed (HIP) at 1150° C. at 35 MPa for 20 minutes to full density and the Vickers hardness averaged 322. The same powder has also been hot pressed to full density. HIP and hot pressing were performed to add to the powder characterization studies and to show other processing options for the powder.

For injection molding, the binder selected was 35% polypropylene, 60% paraffin wax, and 5% stearic acid. The volume fraction powder added was 56% and the powder and binder were mixed using the Haake Torque Rheometer. Using a Battenreid injection molding machine, the injection pressure was 140 MPa and the injection temperature was 120° C. Fabrication of tensile bars allowed for mechanical properties to be measured and 9 mm wrenches gave an example of the part complexity achievable with injection molding.

The debinding schedule removed the majority of the binder through immersion in heptane at a temperature of 38° C. for 4 hours. The parts were then sintered in hydrogen at 1320°, 1335°, and 1350° C. for one hour. High densities were achieved only after sintering at 1350° C. Sintering at 1320° and 1335° C. was not sufficient for 99% dense samples. Tensile testing was performed only for the samples sintered at 1335° and 1350° C. The tensile testing summary is given in Table 1; it compares the average yield strengths and ultimate tensile strengths at room temperature for the injection molded samples. All seven samples were of the same powder; the table thus reflects both the statistical variation among samples and the effect of the sintering temperature.

TABLE 1

| | Tensile Test Results | | | |
|---|---|---|---|---|
| Sample | Sintering Temp. °C. | YS MPa | UTS MPa | % Elongation |
| 1 | 1320 | NT | — | |
| 2 | 1320 | NT | — | |
| 3 | 1335 | 245 | 290 | 2.2 |
| 4 | 1335 | 360 | 402 | 5.1 |
| 5 | 1335 | 290 | 338 | 2.7 |
| 6 | 1350 | 380 | 614 | 7.0 |
| 7 | 1350 | 300 | 568 | 10.2 |

While the invention has been particularly shown and described with reference to preferred embodiments thereof, it will be understood by those skilled in the art that other changes in form and details may be made therein without departing from the spirit and scope of the invention.

We claim:

1. A controlled reactive sintering process for producing a finely divided intermetallic compound comprising:

(a) intimately mixing finely divided reactants;

(b) bringing a portion of said intimately mixed reactants in a protective atmosphere to a temperature sufficient to initiate an exothermic reaction and to form a transient liquid phase;

(c) providing a heat sink to control said exothermic reaction so as to produce a layered body of intermetallic compound;

(d) cooling said layered body of intermetallic compound in said protective atmosphere; and (e) comminuting said layered body of intermetallic compound to provide a finely divided intermetallic compound.

2. A process according to claim 1 wherein said heat sink is provided at least in part by adding a quantity of a product of a reaction to an intimate mixture of reactants for said reaction.

3. A process according to claim 1 wherein said heat sink is in the form of a water cooled reaction vessel.

4. A process according to claim 3 wherein said heat sink additionally comprises a heat-transferring, protective atmosphere.

5. A process according to claim 4 wherein said intermetallic compound is nickel aluminide of particle size from 1 μm to 1 mm.

6. A process according to claim 1 wherein said intermetallic compound is nickel aluminide.

* * * * *